United States Patent [19]

Fox et al.

[11] Patent Number: 4,500,074

[45] **Date of Patent: * Feb. 19, 1985**

[54] FLUID-OPERATED APPARATUS FOR HANDLING AND LIFTING LOADS

[75] Inventors: Albert D. Fox, Novi; Robert J. Kish, Flint; Donn C. Knight, Madison Heights, all of Mich.

[73] Assignee: D. W. Zimmerman Mfg., Inc., Madison Heights, Mich.

[ * ] Notice: The portion of the term of this patent subsequent to Oct. 23, 2001 has been disclaimed.

[21] Appl. No.: 550,374

[22] Filed: Nov. 10, 1983

Related U.S. Application Data

[63] Continuation-in-part of Ser. No. 477,927, Mar. 23, 1983, Pat. No. 4,478,390, which is a continuation-in-part of Ser. No. 351,943, Feb. 24, 1982, Pat. No. 4,462,571.

[51] Int. Cl.[3] ..... B66D 1/08; B66D 1/48

[52] U.S. Cl. ..... 254/270; 254/360

[58] Field of Search ..... 254/264, 270, 331, 360, 254/375, 386

[56] References Cited

U.S. PATENT DOCUMENTS

| | | | |
|---|---|---|---|
| 3,260,508 | 7/1966 | Powell | 254/360 X |
| 3,325,148 | 6/1967 | Powell | 254/360 X |
| 3,384,350 | 5/1968 | Powell | 254/331 X |
| 3,428,298 | 2/1969 | Powell | 254/361 X |
| 3,457,837 | 7/1969 | Powell | 254/360 X |
| 3,526,388 | 9/1970 | Gieger et al. | 254/360 |
| 3,656,154 | 4/1972 | Powell | 254/360 X |
| 3,756,563 | 9/1973 | Stone | 254/331 |
| 3,758,079 | 9/1973 | Workman, Jr. et al. | 254/360 |
| 3,791,627 | 2/1974 | Stone et al. | 254/331 |
| 3,933,388 | 1/1976 | Conboy | 254/270 |

*Primary Examiner*—Stuart S. Levy
*Assistant Examiner*—Katherine Jaekel
*Attorney, Agent, or Firm*—Allen D. Gutchess, Jr.

[57] ABSTRACT

Fluid-operated apparatus is provided for handling and lifting loads of various weights. The apparatus includes a fluid-operated hoist with an elongate member extending therefrom to a load-carrying unit. A pilot fluid-controlled regulator supplies fluid to the hoist and a load-responsive, pilot fluid regulator is carried by the load-carrying unit and supplies pilot fluid to the pilot fluid-controlled regulator. The pilot fluid is varied according to the weight of a load so that the pressure of the fluid supplied to the hoist is accordingly varied by the pilot fluid-controlled regulator to automatically balance the load carried by the load-carrying unit. The load can also be lifted by bypassing the pilot fluid-controlled regulator and controlling flow of fluid to the hoist by a manually-adjustable flow control valve. The apparatus also can include a brake for preventing the elongate member from moving up or down while loads are being changed or are at rest.

6 Claims, 6 Drawing Figures

FLUID-OPERATED APPARATUS FOR HANDLING AND LIFTING LOADS

This application is a continuation-in-part of a copending application of Knight et al, U.S. Ser. No. 477,927, filed Mar. 23, 1983, now U.S. Pat. No. 4,478,390, which is a continuation-in-part of a copending application U.S. Ser. No. 351,943, filed on Feb. 24, 1982, now U.S. Pat. No. 4,462,571.

This invention relates to fluid-operated, load-handling apparatus which is capable of lifting, carrying, and automatically balancing loads of various weights.

Fluid-operated hoists with various hand controls for changing pressure, which controls are manipulated by an operator, are shown in a number of patents assigned to the assignee of the instant patent application. These include U.S. Pat. No. 3,260,508, issued July 12, 1966; U.S. Pat. No. 3,325,148, issued June 13, 1967, U.S. Pat. No. 3,384,350, issued May 21, 1968; and U.S. Pat. No. 3,428,298, issued Feb. 18, 1969. The controls of these patents increase or decrease fluid pressure to the hoists to raise or lower the loads. Some of the controls can also regulate the pressure of the hoists to balance a particular load. However, the pressures can be set for only one or a few loads of predetermined weight and cannot function with loads of other weights without special adjustments being made through the regulators by the operators.

The load-handling apparatus according to the invention enables the fluid-operated hoist to balance loads of various weights in a wide range of values without any adjustment being required whatsoever by an operator and to also lift the loads. The fluid-operated, load-handling apparatus includes a fluid-operated hoist, a pilot fluid-controlled regulator supplying fluid to the hoist, a load-responsive, pilot-fluid regulator for controlling pilot fluid to the pilot fluid-controlled regulator in response to the weight of the load being carried and handled, and an adjustable flow valve controlling the fluid directly to the hoist. The fluid-operated hoist can include a housing forming a pressure chamber along with a movable piston in the housing. A cable drum is supported on a ball-screw assembly adjacent the piston. When the piston moves in a lineal path in the housing, the cable drum rotates to raise or lower a flexible elongate member or cable carried thereby, in order to raise or lower the load. However, other fluid-operated hoists can be employed, such as those incorporating a cylinder with a piston therein and with an elongate member or piston rod extending therefrom.

The pilot fluid-controlled regulator controls the pressure of fluid supplied to the hoist chamber, with this pressure, in turn, being controlled by the pressure of pilot fluid supplied to the regulator. The pilot fluid pressure is controlled by a pilot fluid regulator which is responsive to the weight of the load. The pilot fluid regulator is carried by a load-carrying unit which is connected to the elongate member of the hoist and also to the load. The load-carrying unit includes two members which move toward and away from one another according to the weight of the load, with the pilot fluid regulator being carried by one of the members and engagable by the other to cause the pilot fluid to vary according to the weight being carried and handled by the apparatus. The fluid-operated hoist thereby automatically balances the particular load being handled at that time without any adjustments being required by an operator.

In accordance with the invention, the load may also be lifted by bypassing the pilot and pilot-controlled regulators and controlling the fluid directly to the hoist with an adjustable flow valve.

The fluid-operated, load-handling apparatus also preferably includes a fluid-operated brake which prevents raising or lowering of the elongate member connected between the hoist and the load when the load is not being manipulated by the operator and when a different load is to be handled by the apparatus. This is manually controlled by the operator along with a valve for connecting the pilot fluid regulator with the pilot fluid-controlled regulator.

It is, therefore, a principal object of the invention to provide improved fluid-operated, load-handling apparatus for automatically balancing loads of various weights and for lifting such loads.

Another object of the invention is to provide load-handling apparatus for handling and lifting loads of various weights and which has a manually-controlled, fluid-operated brake.

A further object of the invention is to provide a fluid-operated, hoist with a load-responsive, pilot fluid regulator which changes pilot-fluid pressure in accordance with the weight of the load being carried and with a flow control valve which bypasses the regulator and supplies air directly to the hoist to lift the load.

Many other objects and advantages of the invention will be apparent from the following detailed description of a preferred embodiment thereof, reference being made to the accompanying drawings, in which.

Figure 1:
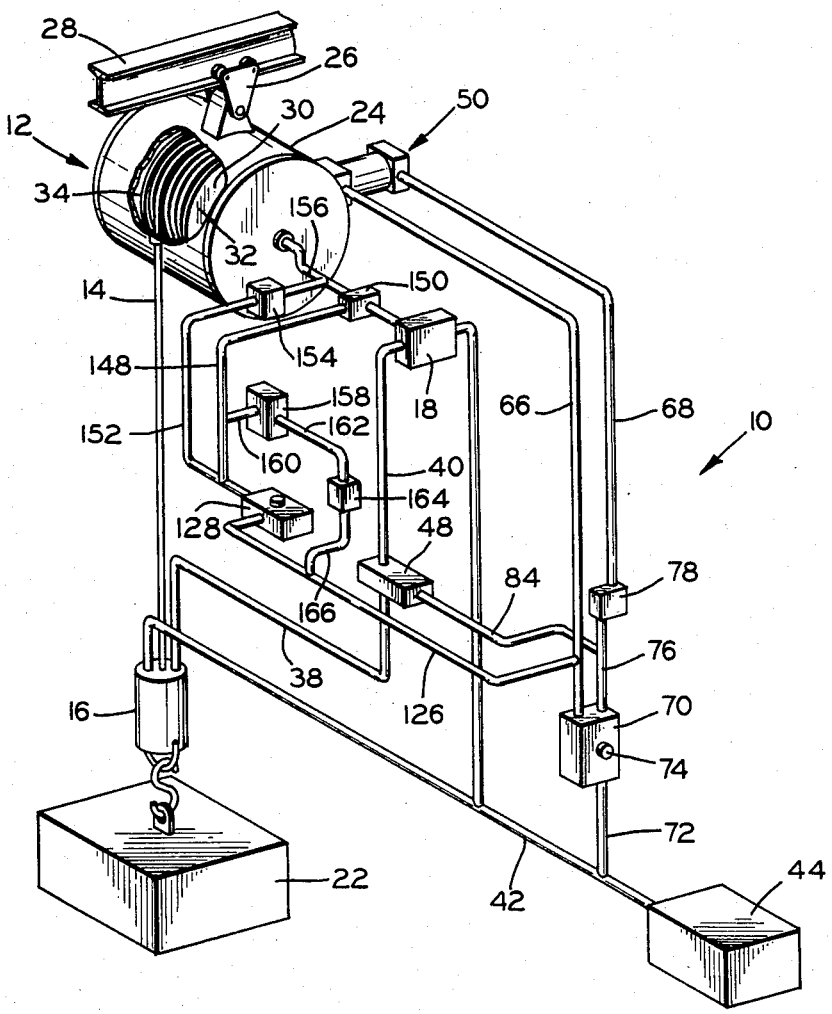
FIG. 1 is a schematic view in perspective of fluid-operated, load-handling apparatus embodying the invention.
Figure 2:
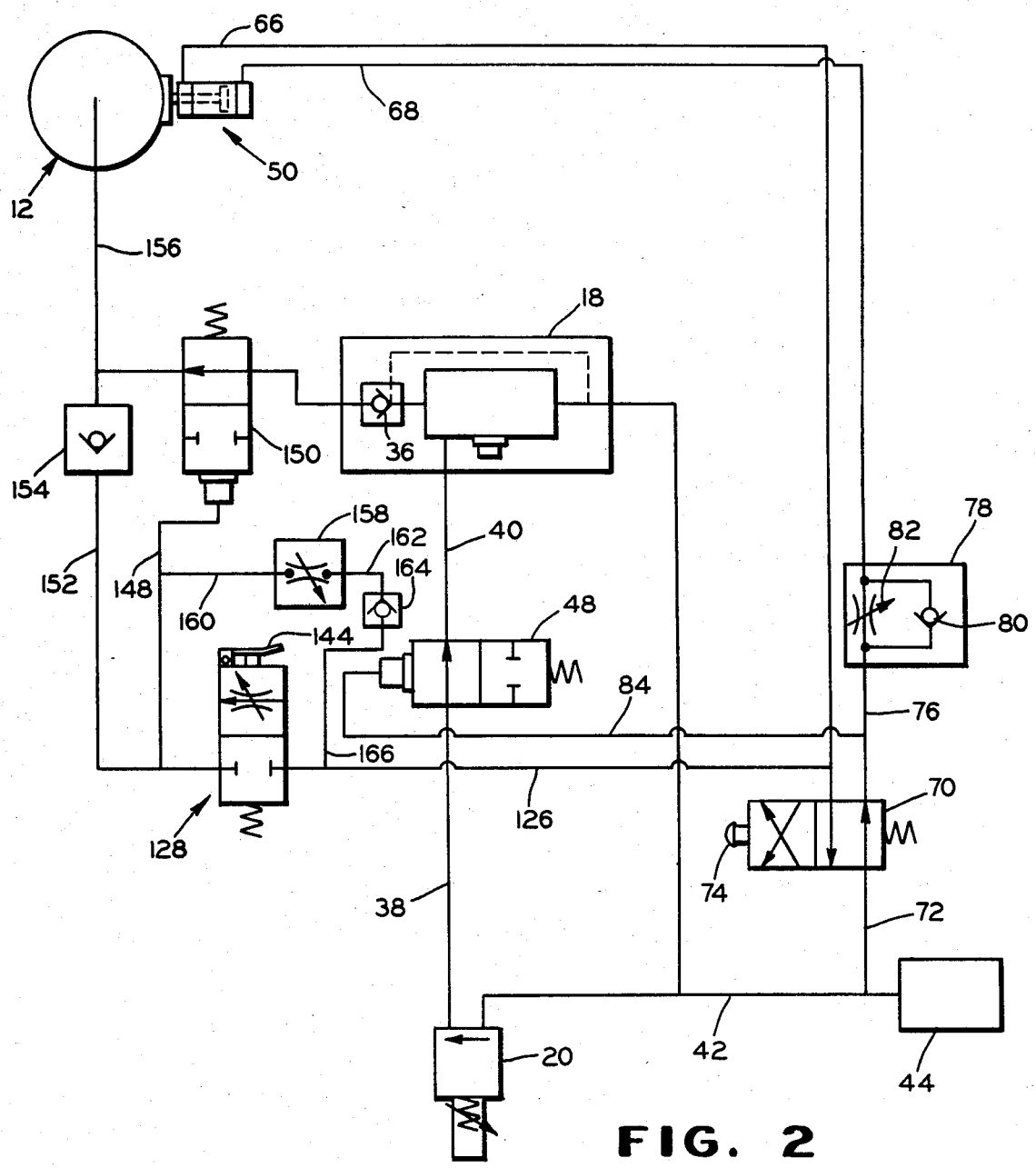
FIG. 2 is a flow diagram diagrammatically showing the components of FIG. 1.
Figure 3:
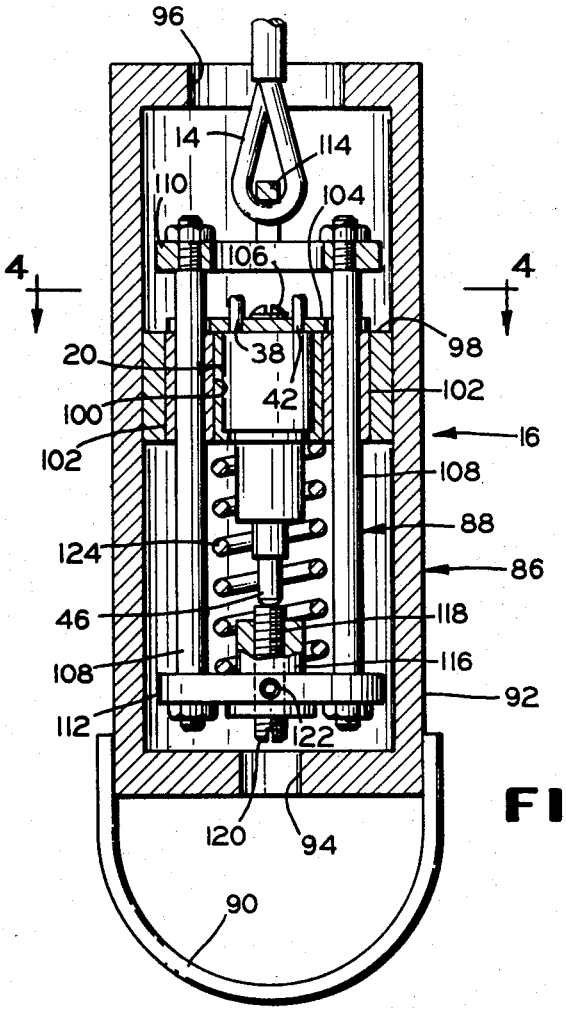
FIG. 3 is an enlarged, somewhat schematic view in vertical cross section of a load carrying unit and a pilot fluid regulator of the apparatus of FIGS. 1 and 2.

Referring to FIG. 1, load-handling apparatus according to the invention is indicated at 10 and basically comprises a fluid-operated hoist 12, an elongate member 14 extending downwardly therefrom to a load-carrying unit 16, a pilot fluid-controlled regulator 18, and a load-responsive, pilot fluid regulator 20 (FIGS. 2 and 3). The load-responsive, pilot fluid regulator 20, carried by the unit 16, supplies pilot fluid to the pilot fluid-controlled regulator 18 which supplies fluid to the hoist. The pilot fluid pressure is varied according to the weight of a load 22, the heavier the load, the higher the pilot fluid pressure and the lighter the load, the lower the pressure. The pressure of the fluid supplied to the hoist is accordingly varied by the regulator 18, this pressure being of a value to automatically balance the load carried by the elongate member 14 and the load-carrying unit 16.

The hoist 12 includes a housing 24 suspended by a trolley 26 from an overhead rail 28. The hoist housing 24 forms a chamber 30, one end of which is closed off by a piston 32. A cable drum 34 is located adjacent the piston 32 and is rotatably supported on a ball-screw assembly (not shown). This support causes the drum 34 to rotate as the piston 32 moves longitudinally in the housing 24. When the piston moves toward the end of the hoist opposite the chamber, the drum 34 rotates in a manner to raise the elongate member 14, the unit 16, and the load 22. This occurs when the pressure in the chamber 30 is above a particular value. Oppositely, when the pressure in the chamber 30 is below a particular value, the weight of the load 22 on the elongate member 14 causes the drum 34 to rotate in a manner to lower the member 14 and to move the piston 32 toward the chamber end of the hoist, reducing the volume of the chamber.

When the pressure in the chamber 30 is adjusted to a particular value to balance the weight of the load 22 and the brake 50 is released, an operator can manipulate the load up and down as if it had substantially no weight, depending upon the friction of the components of the hoist. An operator applying a small upward force to the load will cause the piston 32 to move away from the chamber 30, decreasing the pressure within the chamber 30 below the pressure being supplied by the regulator 18. The regulator 18 then supplies additional air to the chamber until the pressure within the chamber is again equal to the regulated pressure. Likewise, the operator applying a small force downwardly will cause the piston to move toward the chamber 30, increasing the pressure within the chamber above the pressure being supplied by the regulator 18, hence causing the regulator 18 to vent air from the chamber 30 until again pressure within the chamber is equal to the regulated pressure. While the specific type of hoist indicated at 12 is preferred, it is also possible to employ other fluid-sensitive load-handling apparatus, such as a ram-type of hoist including a fluid-operated cylinder, a piston, and an elongate member or piston rod affixed to the piston and extending downwardly therefrom to be connected to a load. While the piston can be hydraulically or pneumatically operated, it will be specifically set forth as used with air in the following discussion.

The pilot fluid-controlled regulator 18, referred to hereafter as a pilot air-controlled regulator, controls the pressure of the fluid, specifically air, supplied to the hoist chamber 30. The regulator 18 can be of the type shown in U.S. Pat. No. 3,457,837. Specifically, the regulator 18 corresponds to the regulator 74 of that patent although other types of regulators can be employed. An air-operated check valve 36 (FIG. 2) corresponds to the air-operated check valve 76 of the patent, the check valve 36 automatically closing in the event of failure of the supply air, to prevent air from being exhausted from the chamber 30, in which case, the load 22 could suddenly drop. The pilot air regulator 20 replaces the pilot air regulator 78 of the aforesaid patent. A more detailed description of operation of the regulator 18 with respect to manipulation of the load up and down is set forth in the aforesaid patent and will not be discussed in further detail.

The pilot air regulator 20 (FIGS. 2 and 3) supplies pilot air through lines 38 and 40 (FIG. 2) to the pilot air-controlled regulator 18. The regulators 18 and 20, in turn, receive fluid or air through a line 42 from a supply 44. The regulator 20 has a spring-loaded plunger 46 (FIG. 3) extending therefrom which controls the pressure output of the regulator. As the plunger 46 extends further into the regulator, the output pressure through the line 38 increases, and vice versa. Similarly when the higher pilot air pressure is received by the regulator 18, it supplies air under higher pressure to the hoist chamber 30, and vice versa. The pilot air regulator 20 is commercially available, being obtainable, for example, from Fairchild Industrial Products Division located in Winston-Salem, N.C., model 70 BR.

A fluid-operated, two-way valve 48 is located between the lines 38 and 40. In a closed, unactuated position, the pilot air regulator 20 is shut off from the pilot air-controlled regulator 18 with any pilot air then trapped in the regulator 18. In the actuated position of the valve 48, as shown, the regulator 20 communicates with the regulator 18 which can supply higher pressure pilot air thereto or exhaust it therefrom.

Figure 5:
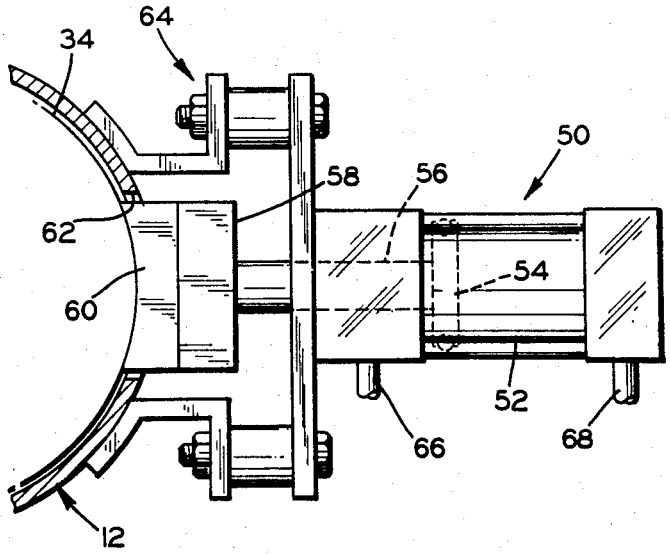
FIG. 5 is a schematic side view in elevation, with parts in cross section, of part of a hoist and a brake shown in FIGS. 1 and 2.

Referring particularly to FIG. 5, a fluid-operated brake 50 can be employed to prevent rotation of the hoist drum 34 to maintain the elongate member 14 in a fixed position. The brake 50 includes a fluid-operated cylinder 52 having a piston 54 therein with a piston rod 56 extending outwardly therefrom. The brake rod 56 terminates in a brake pad 58 to which is affixed a brake shoe 60. This has an arcuate face which engages the periphery of the drum 34 through an opening 62 in the hoist housing 24. The shoe 60 may also engage the extreme outer surface of the elongate member 14, depending upon the extent to which the member 14 is recessed in a spiral groove in the drum 34. The brake 50 is affixed to the housing 24 through suitable brackets indicated at 64.

Fluid, and specifically air, is supplied to the rod end of the brake 50 through a line 66 and to the blind end of the cylinder 52 through a line 68. Air is supplied through the line 66 from a four-way supply valve 70, a line 72, and the air supply 44. This occurs when the valve 70 is in an actuated position when a button 74 is pressed. When the valve 70 is not actuated, as shown in FIG. 2, air is supplied to the blind end of the cylinder through a line 76, a flow control valve 78, and the line 68. The piston 54 is then extended to cause the brake shoe 60 to engage the hoist drum 34. When the air is supplied through the line 76, it flows unrestrictedly through a check valve 80 of the valve 78 with air exhausted from the rod end of the cylinder through the line 66 to an exhaust port of the four-way valve 70. When air is supplied through the line 66 to the rod end of the cylinder, air is exhausted from the blind end through an adjustable flow-control restriction 82 of the valve 78 so that the air is exhausted more slowly. This prevents premature release of the brake to assure that the valve 48 will function prior to the release of the hoist drum 34.

When the valve 70 is not actuated, air is also supplied through a line 84 to the air-operated valve 48 to move the valve to the actuated position and connect the pilot air regulator 20 with the pilot air-controlled regulator 18. Air is then supplied to the hoist chamber 30 from the regulator 18 at a pressure determined by the pressure of the pilot air supplied by the regulator 20. The hoist 12 accordingly balances the load when the brake is released. When the valve 70 is actuated, air from the valve 48 is exhausted back through the exhaust port of the valve 70 through the line 84 and the valve 48 reverts to the unactuated position.

Figure 4:
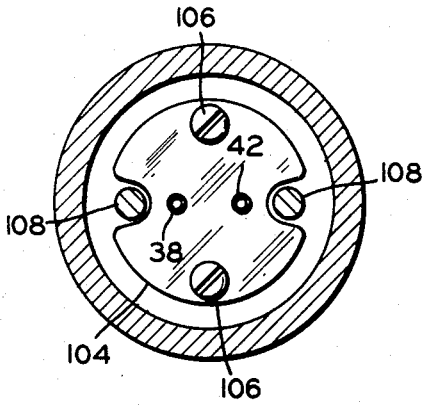
FIG. 4 is a view in transverse cross section taken along the line 4—4 of FIG. 3.

The unit 16 basically comprises a first, load-connecting member 86 (FIGS. 3 and 4) and a second, cable-connecting member 88. The load-connecting member 86 includes a suitable connector 90 affixed to a lower portion of a cylindrical housing 92 to receive a load hook. The housing also has an access opening 94 at its lower end and a cable-receiving opening 96 at its upper end to receive the cable and the lines 38 and 42. A dividing wall 98 is affixed to and extends across an intermediate portion of the housing 92 and has a central opening 100 to receive the body of the pilot air regulator 20 and two diametrically-opposed bushings 102. The regulator 20 is retained within the opening 100 of dividing wall 98 by an upper mounting plate 104 which is fastened to the top of the dividing wall 98 by suitable fasteners 106.

The cable-connecting member 88 has slidable rods 108 received in the bushings 102 and connected to upper and lower plates 110 and 112. While two of the rods 108 and the bushings 102 are shown for clarity of illustration, three of each are preferred for greater stability. The upper plate 110 has a suitable connector 114 received in a loop at the lower end of the cable 14. The lower plate 112 has a centrally-located, threaded mounting block 116 suitably affixed therein with an adjusting screw 118 extending through the block 116 and threadedly engaged therewith. The adjusting screw 118 has a lower slotted end 120 by means of which the screw 118 can be turned in the block by a tool inserted through the access opening 94. A transverse setscrew 122 engages the side of the screw 118 and can be loosened to permit adjustment of the screw and then tightened to maintain the screw in position. The setscrew is accessible through a slot (not shown) in the side wall of the housing 92. The upper end of the adjusting screw 118 engages the plunger 46 of the regulator 20 and adjusts the output of the regulator, when the screw is turned. Once the screw is properly adjusted for a particular installation, further adjustment is seldom needed.

A large compression spring 124 seats against the lower surface of the wall 98 around the regulator 20 and also seats against the upper surface of the lower plate 112, around the threaded mounting block 116. This spring 124 thereby urges the members 86 and 88 away from one another when the brake 50 is set, preventing the elongate member 14 from moving up or down. The load 22 connected to the connector 90 urges the member 86 and 88 toward one another, causing the adjusting screw 118 to depress the plunger 46 of the regulator 20 more fully and thereby increase the pilot air pressure output of the regulator in proportion to the load applied. The spring 124 is selected with a spring rate such that when a load is attached to the connector 90 the deflection of the spring 124 will be equal to the deflection of the plunger 46, causing the regulator 20 to supply air at a particular pressure to the regulator 18 such that the pressure then supplied to the chamber 30 will cause the hoist 18 to balance the load 12.

Figure 6:
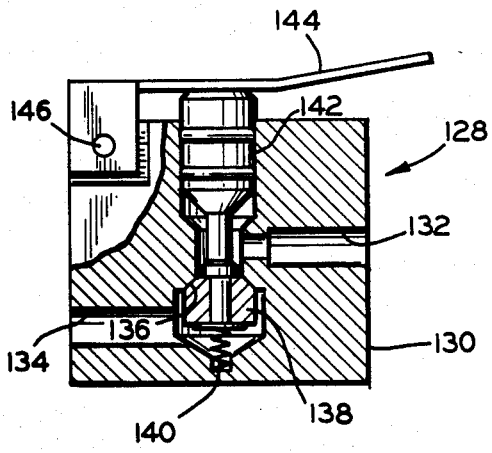
FIG. 6 is a somewhat schematic view in cross section of a manually-adjustable flow control valve of the apparatus of FIGS. 1 and 2.

In accordance with the invention, the load 22 can also be lifted or raised by the load-handling apparatus 10 to greatly increase the versatility thereof. Accordingly, a line 126 from the line 66 downstream of the four-way valve 70 supplies air to an operator-controlled or manually-operated, fluid-control valve 128 when the valve 70 is actuated with the button 74 depressed. The valve 128, shown in FIG. 6, has a housing 130 forming inlet and outlet passages 132 and 134, with a valve seat 136 therebetween. A valve body 138 is urged toward a closed position against the seat 136 by a spring 140. The valve body has a stem 142 extending upwardly where it is engaged by a manually-operated lever 144 pivotally connected to the housing 130 by a pin 146. The extent to which the lever 144 is depressed controls the flow of air through the valve 128 and the pressure of air in the hoist.

When the valve 128 is open, air is supplied through a line 148 to a two-position, two-way, blocking valve 150. Air is also supplied through a line 152 to a check valve 154. The air to the blocking valve 150 moves it to an actuated position in which it blocks or isolates the pilot air-controlled regulator 18 from the hoist 12. When air under sufficient pressure is supplied to the check valve 154, with the pressure being above that in the hoist chamber 30, as determined by the regulator 18, the check valve opens and air under increased pressure is applied through a line 156 to the piston 32 to raise the load 22. An adjustable flow control valve 158 is connected to the line 148 through a line 160. The valve 158 is also connected through a line 162 to a check valve 164 which, in turn, is connected to the line 126 through a line 166. When air is supplied through the valve 70 in its actuated position, the pressure in the line 166 is equal to or greater than in the line 162 and the check valve 164 is maintained closed. When the lever 144 is released and the valve 128 is closed, and when the button 74 is released and the valve 70 returns to its unactuated position, air in the line 126 exhausts to atmosphere which enables the check valve 164 to open. Air can then bleed from the line 148 and the line 152 through the line 160, the valve 158 and the line 162. The blocking valve 150 then returns to its unactuated position with the regulator 18 again connected with the hoist 12, and with the check valve 154 then being subjected to a higher pressure from the line 156 than the line 152 so that this check valve closes.

In the operation of the apparatus 10, when the load 22 is connected with the member 86, and when the four-way valve 70 is in the unactuated position of FIG. 2, the brake 50 is set and the two-way valve 48 is actuated to the right hand position to connect the regulators 18 and 20. With the load 22 suspended, the pilot air pressure from the regulator 20 is transmitted through the pilot air-controlled regulator 18 at a value such that the pressure from the regulator 18 to the hoist chamber 30 will be sufficient to automatically balance the suspended load 22. When the button 74 is pressed by the operator, the four-way valve 70 moves to the actuated position, causing the air to be supplied to the rod end of the brake cylinder 52 and to be exhausted from the blind end through the flow control restriction 82 to the exhaust port of the valve 70. By the time the brake is released, the two-way valve 48 has shifted back to the unactuated position of FIG. 2 with the pilot air exhausted through the line 84 to the exhaust port of the valve 70. Consequently, the pilot air is trapped in the regulator 18 by the now-closed two-way valve 48. The operator can then manually move the load 22 about easily in its balanced condition, applying just enough force up or down to overcome the friction in the system. The valve 70 can have a detent or a type of lever such that the valve will remain in the actuated position, as determined by the depression of the button 74, until the valve is released. Thus, the operator need not hold in the button 74 while manipulating the load 22.

When the operator desires to raise the load by the hoist 12 without physical assistance, both the valve 70 and the valve 128 are actuated. This supplies air to the valve 150 to block the regulator 18 and supplies the hoist chamber 30 with increased air pressure when such pressure is above the existing pressure therein, opening the check valve 154. An increased pressure within the chamber 30 causes the piston 32 to move away from the chamber, urging the drum 34 to rotate in a manner to raise the elongate member 14, the unit 16, and the load 22. The movement of the piston 32 away from the chamber 30 causes an increase in volume and decrease in pressure within the chamber 30. Hence movement of the piston will continue in that direction until the pressure within the chamber has decreased to a value which causes the hoist 12 to again balance the load 22. When the valve 70 is not actuated, pilot air to the blocking valve 150 is shut off and exhausted and the valve resumes its unactuated condition with the regulator 18 then connected to the hoist chamber through the line 156. The valve 48, being supplied with pilot air through the line 84, is in its actuated position, allowing communication between the regulator 20 and the pilot air-operated regulator 18. This communication causes the regulator 18 to readjust its pressure supplied to the chamber 30 in accordance with any change in load value with respect to the load which was sensed by load responsive unit 16 just prior to the last actuation of the valve 70. If the valve 70 is unactuated, the brake 50 is also applied. When only the valve 70 is again actuated, the load 22 is in a balanced condition and can be lowered easily by the operator pushing down slightly on the load to overcome friction in the system, the brake 50 then being released.

Various modifications of the above-described embodiment of the invention will be apparent to those skilled in the art, and it is to be understood that such modifications can be made without departing from the scope of the invention, if they are within the spirit and the tenor of the accompanying claims.

We claim:

1. Load-handling apparatus comprising a fluid-operated hoist having a housing, a piston moveable in said housing, said housing and said piston forming a fluid chamber, a hoist drum rotatably supported in said housing and rotated as said piston moves in a lineal path in said housing, a flexible, elongate member wound on said hoist drum and extending downwardly from said drum for urging a load in one direction when fluid pressure applied to the chamber exceeds a particular value and for enabling the load to move in another direction when the pressure applied to the chamber is less than a particular value, a pilot fluid-controlled regulator for applying fluid pressure to said fluid chamber in response to pilot fluid pressure applied to said regulator, a load-responsive, pilot fluid regulator for applying pilot fluid to said pilot fluid-controlled regulator, a blocking valve between said pilot fluid-controlled regulator and said chamber having one position enabling communication between said pilot fluid-controlled regulator and said chamber and a second position isolating said pilot fluid-controlled regulator from said chamber, an adjustable flow control valve communicating with said blocking valve for bleeding air from said blocking valve to enable said blocking valve to move from the second position to the one position, a fluid-operated brake having a brake shoe engagable with and retractable from said hoist drum, means for controlling the supply of fluid to said brake, and a manually-operated, fluid-control valve for supplying fluid to said fluid chamber independently of said pilot fluid-controlled regulator and said load-responsive, pilot fluid regulator, said manually-operated, fluid-control valve also supplying fluid to said blocking valve to move said blocking valve from the one position to the second position when said manually-operated, fluid-control valve supplies fluid to said hoist chamber.

2. Load-handling apparatus according to claim 1 characterized by line and check valve means connecting said adjustable flow control valve with said controlling means to enable said adjustable flow control valve to bleed fluid from said blocking valve when said controlling means supplies fluid to said brake.

3. Load-handling apparatus comprising a fluid-operated hoist having a housing, a piston movable in said housing, said housing and said piston forming a fluid chamber, a hoist drum rotatably supported in said housing and rotated as said piston moves in a lineal path in said housing, a flexible, elongate member wound on said hoist drum and extending downwardly from said drum for urging a load in one direction when fluid pressure applied to the chamber exceeds a particular value and for enabling the load to move in another direction when the pressure applied to the chamber is less than a particular value, a pilot fluid-controlled regulator for applying fluid pressure to said chamber in response to pilot fluid pressure applied to said regulator, a load-responsive, pilot fluid regulator for supplying fluid to said pilot fluid-controlled regulator for increasing pressure of pilot fluid to said pilot fluid-controlled regulator when the load is heavier than a particular value and for decreasing the pressure of pilot fluid to said pilot fluid-controlled regulator when the load is lighter than a particular value, a fluid-operated brake having a brake shoe engagable with and retractable from said hoist drum, means for controlling the supply of fluid to said brake, a fluid-control valve for supplying fluid to said fluid chamber independently of said regulators and at a pressure higher than the pressure supplied to said fluid chamber through said fluid-controlled regulator, a blocking valve between said pilot fluid-controlled regulator and said fluid chamber having one position enabling communication between said pilot fluid-controlled regulator and said chamber and a second position isolating said pilot fluid-controlled regulator from said chamber, said fluid-control valve supplying fluid to said blocking valve to move said blocking valve from the one position to the second position when said fluid-control valve supplies fluid to said fluid chamber, and an adjustable flow control valve communicating with said blocking valve for bleeding air from said blocking valve to enable said blocking valve to move from the second position to the one position.

4. Load-handling apparatus according to claim 3 characterized by line and check valve means connecting said adjustable flow control valve with said controlling means.

5. Load-handling apparatus comprising a fluid-operated hoist having a chamber and a piston, elongate means moved by said piston and extending from said hoist for urging a load in one direction when fluid pressure applied to the chamber exceeds a particular value and for enabling the load to move in another direction when the pressure applied to the chamber is less than a particular value, a pilot fluid-controlled regulator for applying fluid pressure to said chamber in response to pilot fluid pressure applied to said regulator, a load-responsive pilot fluid regulator for supplying pilot fluid to said pilot fluid-controlled regulator for increasing pressure of pilot fluid to said pilot fluid-controlled regulator when the load is heavier than a particular value and for decreasing the pressure of pilot fluid to said pilot fluid-controlled regulator when the load is lighter than a particular value, a blocking valve between said pilot fluid-controlled regulator and said fluid chamber having one position enabling communication between said pilot fluid-controlled regulator and said chamber and a second position isolating said pilot fluid-controlled regulator from said chamber, a manually-operated, fluid-control valve for supplying fluid to said hoist chamber independently of said load-responsive pilot fluid regulator and said pilot fluid-controlled regulator, said fluid-control valve also supplying fluid to said blocking valve to move said blocking valve from the one position to the second position when said fluid-control valve supplies fluid to said fluid chamber, and an adjustable flow control valve communicating with said blocking valve for bleeding air from said blocking valve to enable said blocking valve to move from the second position to the one position.

6. Load-handling apparatus according to claim 5 characterized by a manually-controlled supply valve for supplying fluid to said manually-operated, fluid-control valve when said manually-controlled supply valve is in an actuated condition and for exhausting fluid from said manually-operated, fluid-control valve when said manually-controlled supply valve is in an unactuated condition, and line and check valve means connecting said adjustable flow control valve with said manually-operated, fluid-control valve to exhaust fluid from said adjustable flow control valve when said manually-controlled supply valve is in its unactuated condition.

* * * * *